United States Patent [19]

Dalo

[11] Patent Number: 4,881,312

[45] Date of Patent: Nov. 21, 1989

[54] METHOD FOR MANUFACTURING A FITTING FOR A HEAT EXCHANGER

[75] Inventor: Dominic N. Dalo, Buffalo, N.Y.

[73] Assignee: General Motors Corporation, Detroit, Mich.

[21] Appl. No.: 222,875

[22] Filed: Jul. 22, 1988

[51] Int. Cl.[4] ..... B21D 53/08

[52] U.S. Cl. ..... 29/157.3 C; 29/458; 29/525.2; 29/527.4; 29/157.3 R; 228/183

[58] Field of Search ..... 29/157.3 R, 157.3 C, 29/157.3 D, 157.3 H, 157.4, 458, 527.4; 228/139, 183, 190, 193; 285/176, 405, 413

[56] References Cited

U.S. PATENT DOCUMENTS

| | | | |
|---|---|---|---|
| 320,645 | 6/1885 | Fischer | 285/176 X |
| 355,274 | 12/1886 | Manly et al. | 29/526.2 |
| 2,068,955 | 1/1937 | Kritzer et al. | 257/255 |
| 2,349,792 | 5/1944 | Rosenblad | 228/183 X |
| 2,528,343 | 10/1956 | Davis | 285/405 X |
| 2,792,201 | 5/1957 | Whistler | 257/255 |
| 3,324,534 | 6/1967 | Spurk | 285/176 |
| 3,628,923 | 12/1971 | White | 228/183 X |
| 4,182,408 | 1/1980 | Laber | 228/183 X |
| 4,272,006 | 6/1981 | Kao | 228/183 |
| 4,500,030 | 2/1985 | Gerber et al. | 228/183 X |
| 4,727,935 | 3/1988 | Lapeyre | 29/157.3 R X |
| 4,804,040 | 2/1989 | Jan-Ove et al. | 29/157.3 C X |

FOREIGN PATENT DOCUMENTS

| | | | |
|---|---|---|---|
| 180632 | 9/1985 | Japan | 29/151.3 D |

*Primary Examiner*—Timothy V. Eley
*Assistant Examiner*—Frances Chin
*Attorney, Agent, or Firm*—Ronald L. Phillips

[57] ABSTRACT

A fitting for a two flat tube serpentine heat exchanger having high burst pressure comprises a header plate with two slots for receiving the flat tubing and a cover plate with a port, a nipple protruding from the port, and a recess surrounding the port and extending over the slots to provide communication between the port and the slots. The plates are formed by extrusion with the appropriate apertures, cut to the desired thickness and the recess is milled out, or the plates and apertures are stamped from sheet rock. The plates are welded together at their common periphery or brazed together at their margins outboard of the recess.

3 Claims, 1 Drawing Sheet

METHOD FOR MANUFACTURING A FITTING FOR A HEAT EXCHANGER

FIELD OF THE INVENTION

This invention relates to a fitting and the method of making a fitting for a heat exchanger and particularly to such a fitting which serves as an inlet or outlet port.

BACKGROUND OF THE INVENTION

It is common practice to construct heat exchangers with one or more tubes to conduct a working fluid through a long and sometimes tortuous path to obtain heat transfer between the working fluid and the ambient fluid surrounding the tubes. It has been recognized that paths comprising two or more tubes in parallel impose a smaller pressure drop between the inlet and outlet of the heat exchanger with resulting improvement in system efficiency.

The chief tube designs which have evolved for heat exchanger use are a round tube and a flat or oval tube. The tubes are connected to input and output ports which generally take the form of a round stub pipe or nipple, the connections being perfected by special fittings or manifolds adapted to the particular heat exchanger design. It is always important that the fittings enhance system integrity. For that reason the fittings must have a high burst pressure when used with high pressure systems.

When a heat exchanger employs round tubes, two parallel paths are accommodated by a fitting formed of a round tube bent in a U-shape to engage the ends of both tubular paths and a tubular tee branch forming the port at the bend of the U. This fitting has been quite successful. On the other hand, when flat or oval tubes are used for parallel paths a design using a U-shaped flat tube for joining the path ends has the weakness that the internal pressure tends to deform the flat tube into a round shape. The consequential strain at the joints results in a low burst pressure of the fitting and mating tubes. It is thus desired to provide a fitting for plural flat tubes having a high burst pressure.

SUMMARY OF THE INVENTION

It is therefore an object of the invention to provide a fitting for flat tubes which has a high burst pressure. It is another object to provide such a fitting which is readily coupled to a heat exchanger. It is also an object of the invention to provide a method of making such a fitting.

The invention is carried out by a fitting for coupling to a flat tube serpentine heat exchanger comprising; tube coupling means comprising a first plate having at least one slot shaped to conform to and receive flat tubing, a nipple, nipple coupling means comprising a second plate joined to the nipple and joined at an interface to the first plate, the second plate having a single opening communicating with the nipple and conforming to the nipple size, and a cavity in one of the plates at the interface extending between the single opening and the slot for fluid distribution between the nipple and the slot.

The invention is further carried out by the method of making a fitting for a heat exchanger having flat tubing comprising the steps of; forming a rectangular aluminum plate having slots for coupling with heat exchanger tubing, forming a second rectangular aluminum plate having a round opening for coupling with a nipple, forming a recess in the second plate around the opening of sufficient size to couple the opening to the slots when the plates are assembled, assembling the first and second plates at an interface and assembling a nipple into the opening, and bonding the second plate to the first plate and bonding the second plate to the nipple at the opening.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE PREFERRED EMBODIMENT

Figure 1:
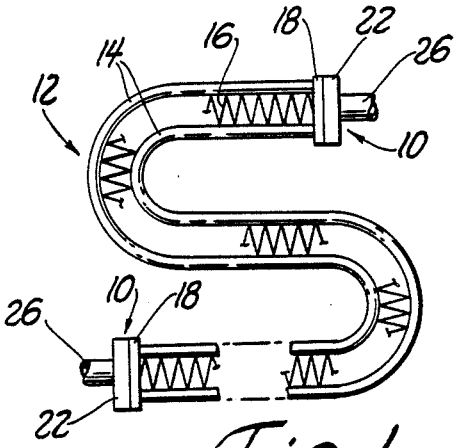
FIG. 1 is an elevational view of a serpentine heat exchanger with fittings according to the invention.

FIG. 1 illustrates an application of the fittings of the invention. A fitting 10 is attached to each end of a serpentine heat exchanger 12 to provide inlet and outlet ports. The heat exchanger 12 comprises a spaced pair of flat aluminum tubes 14 connected in parallel and shaped in a serpentine pattern having many loops, although two loops are shown. An aluminum fin or air center 16 bridges the space between the tubes and facilitates heat transfer to the surrounding air. The heat exchanger may have more than two tubes 14 or only one, however two tubes is the preferred type and the fitting of the invention will be described in that context. It will be apparent, however, that the invention is not limited to a fitting for two tubes. In the same way, the preferred heat exchanger material is aluminum and the fitting is preferably composed entirely of aluminum parts but the invention is not limited to that material. The function of the fittings 10 is to couple the flat heat exchanger tubes to round external fluid conduits and requires leak free connections, high burst pressure and efficient flow distribution to and from the tubes.

Figure 2:
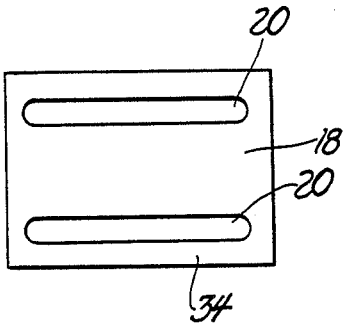
FIG. 2 is a component of a fitting of FIG. 1 comprising a first plate for coupling to heat exchanger tubing.
Figure 3:
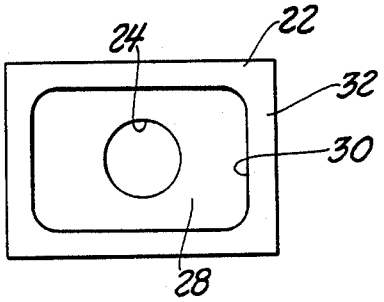
FIG. 3 is a component of a fitting of FIG. 1 comprising a second plate for coupling to an inlet or outlet nipple.
Figure 4:
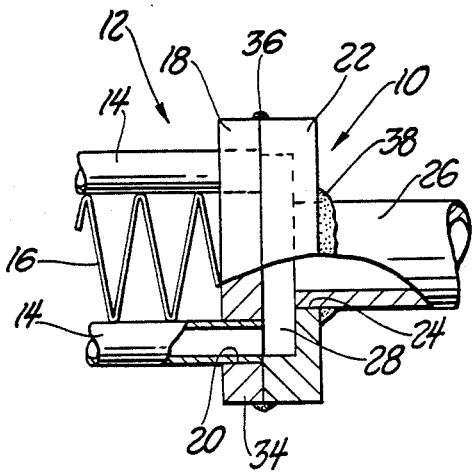
FIG. 4 is a partially sectioned view of the fitting of FIG. 1.

FIGS. 2, 3 and 4 show the details of the fitting 10 which meets these needs. A generally rectangular plate 18 has a pair of elongated holes or slots 20 spaced to align with the flat tubes 14 of the heat exchanger. The slots 20 are sized to conform to the periphery of the tubes 14 so that the tubes may be inserted into the slots 20 and bonded to the plate 18. A plate 22 of the same outer size and shape as the plate 18 is joined to the plate 18 at an interface. The plate 22 has a central round hole 24 for receiving a nipple 26 which is the inlet or outlet of the fitting. The nipple 26 extends from one side of the plate 22 and a recess 28 is formed in the other side of the plate in an area surrounding the opening 24 and extending substantially over the slots 20 in the plate 18. The recess 28 is generally rectangular in outline and is bounded by sidewalls 30 normal to the plane of the interface. The margin 32 of the plate 22 outboard of the recess 28 is in contact with the mating margin surface 34 of the plate 18 and overlaps the openings a small amount to form stops for the tubes 14 when they are inserted into the fitting. The plates are joined by a weld seam 36 around the periphery at the interface. Also the nipple 26 is joined to the plate 22 by a weld seam 38.

Figure 5:
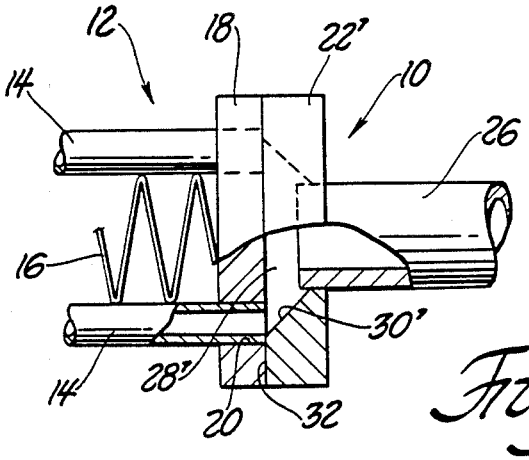
FIG. 5 is a partially sectioned view of a second embodiment of the fitting according to the invention.

Another embodiment of the fitting is shown in FIG. 5. It differs from the above described embodiment by its joining mechanism and by the shape of the recess 28'. The recess side walls 30' are tapered from the opening 24 to the margin 32. This results in a modified conical or pyramidal recess 28'. The parts are brazed together rather than welded. To facilitate brazing the parts are made of aluminum clad with a braze alloy.

In the manufacture of the fitting 10 there are two approaches to making the plates 18 and 22 and two joining processes to be considered. In the first method, the plates are extruded and cut to the desired thickness. This results in very accurate slots 20 and hole 24 for joining with the tubes 14 or the nipple 26. The recess 28 is formed in the plate 22 by milling. Then the plates are joined to each other and to the nipple 26 by welding. While the welding is an excellent joining technique for tight joints, it requires individual processing of the fittings. As a variant on the first method, the plates could be made by stamping and then welded together.

The second method calls for stamping the plates from aluminum plate stock and stamping out the slots 20 and hole 24. The recess 28 or 28' is also formed by a stamping step. The plates and the nipple are assembled along with braze filler alloy in the form of foil or wire at the joint interfaces and joined by brazing. Using a method that is well known for brazing aluminum heat exchangers, the parts can be processed in large batches by immersion in a molten salt bath held to just the right temperature so that the braze filler alloy melts and flows to secure the junction points of the parts. In the case of the nipple 26, the braze filler alloy in the form of a ring runs into the nipple/plate interface to form a leak free bond.

In use, the fittings 10, made by either method, are applied to the ends of the oval tubes 14 of the serpentine heat exchanger 12. The overlap of the margin 32 and the slots 20 prevents the tubes 14 from entering too far into the fitting. The joints of the tubes and the fittings are completed by brazing. When the fitting is made by brazing it is advantageous to assemble the fitting to the tubes 14 prior to brazing to braze all the joints in one operation.

It will thus be seen that fittings resistant to deformation by high pressure can be fabricated by economical methods and moreover a choice of methods is available to tailor the fabrication to a particular usage.

The embodiments of the invention in which an exclusive property or privilege is claimed are defined as follows:

1. The method of making a fitting for a heat exchanger having flat tubing comprising the steps of; forming a rectangular aluminum plate having slots for coupling with heat exchanger tubing, forming a second rectangular aluminum plate having a round opening for coupling with a nipple, forming a recess in the second plate around the opening of sufficient size to couple the opening to the slots when the plates are assembled, assembling the first and second plates at an interface and assembling a nipple into the opening, and bonding the second plate to the first plate and bonding the second plate to the nipple at the opening.

2. The invention as defined in claim, 1 wherein; the plates are formed by stamping from aluminum sheet stock, the assembling step includes assembling braze filler alloy elements at the interface, and the bonding step comprises brazing the first and second plates together at the interface in a region outboard of the recess and brazing the nipple to the opening.

3. The invention as defined in claim 1 wherein; the step of forming the first plate comprises extruding a rectangular aluminum part with a plurality of slots extending therethrough and cutting off a first plate from the part, the step of forming the second plate comprises extruding a second rectangular aluminum part with a circular hole extending therethrough and cutting off a second plate from the second part, and the bonding step comprises welding peripheries of the first and second plates together at the interface.

* * * * *